US008297460B2

(12) United States Patent
Riordan

(10) Patent No.: US 8,297,460 B2
(45) Date of Patent: Oct. 30, 2012

(54) VAPOR BARRIER FOR FLAMMABLE LIQUID STORAGE TANKS

(76) Inventor: Joseph Riordan, Anchorage, AK (US)

( * ) Notice: Subject to any disclaimer, the term of this patent is extended or adjusted under 35 U.S.C. 154(b) by 357 days.

(21) Appl. No.: 12/662,655

(22) Filed: Apr. 27, 2010

(65) Prior Publication Data

US 2010/0294761 A1 Nov. 25, 2010

Related U.S. Application Data

(60) Provisional application No. 61/213,265, filed on May 21, 2009.

(51) Int. Cl.

| | |
|---|---|
| ***B65D 90/22*** | (2006.01) |
| ***B65D 88/34*** | (2006.01) |
| ***A62C 3/06*** | (2006.01) |
| *F17C 1/00* | (2006.01) |
| *F17C 3/00* | (2006.01) |

(52) U.S. Cl. ..... 220/88.1; 220/216; 220/560.01; 169/66; 169/68; 428/920

(58) Field of Classification Search ..... 220/88.1, 220/88.2, 216, 219, 277, 560.01; 169/66, 169/68; 428/920

See application file for complete search history.

(56) References Cited

U.S. PATENT DOCUMENTS

| | | | | |
|---|---|---|---|---|
| 2,797,141 | A | | 6/1957 | Veatch et al. |
| 2,936,834 | A | | 5/1960 | Gomory |
| 3,192,877 | A | | 7/1965 | Wright |
| 3,401,818 | A | | 9/1968 | Hagen |
| 3,687,329 | A | | 8/1972 | Baum |
| 3,697,422 | A | | 10/1972 | Mackie |
| 3,822,807 | A | | 7/1974 | MacDonald et al. |
| 3,998,204 | A | | 12/1976 | Fuchs et al. |
| 4,303,732 | A | | 12/1981 | Torobin |
| 4,361,190 | A | * | 11/1982 | Szego ..... 169/48 |
| 5,097,907 | A | | 3/1992 | Alhamad et al. |
| 5,816,332 | A | | 10/1998 | Alhamad |
| 6,062,417 | A | | 5/2000 | Evans |

(Continued)

FOREIGN PATENT DOCUMENTS

DE 4135678 A1 5/1993

(Continued)

OTHER PUBLICATIONS

European Patent Office; European Search Report for EP 10164411; Feb. 3, 2011; European Patent Office; The Hague, Netherlands.

*Primary Examiner* — Anthony Stashick
*Assistant Examiner* — Madison L Poos
(74) *Attorney, Agent, or Firm* — Kelly Kordzik; Matheson Keys Garsson & Kordzik PLLC

(57) ABSTRACT

The vapor barrier for flammable liquid storage tanks provides a gas impermeable layer for covering the surface of a flammable liquid stored within a conventional flammable liquid storage tank, a tanker, a vessel or the like. The vapor barrier is formed from a plurality of spherical buoyant members. Each spherical buoyant member has a heat-resistant core or shell, a heat-reactive intumescent or flame retardant layer formed on an outer surface of the heat-resistant core, and an antistatic and oil-phobic layer formed on an outer surface of the heat-reactive intumescent layer. The vapor barrier may further be used with liquid storage tanks in which separation between the liquid and vapor phases is beneficial to prevent oxidation or other undesirable reactions.

20 Claims, 4 Drawing Sheets

U.S. PATENT DOCUMENTS

| | | | | |
|---|---|---|---|---|
| 6,171,689 | B1 * | 1/2001 | Kaytor et al. | 428/315.5 |
| 6,220,469 | B1 | 4/2001 | Basseches | |
| 7,331,400 | B2 | 2/2008 | Rowen | |
| 2007/0284120 | A1 | 12/2007 | Rowen | |

FOREIGN PATENT DOCUMENTS

| | | | |
|---|---|---|---|
| FR | 2602977 | A1 | 2/1988 |
| GB | 1454492 | | 11/1976 |
| GB | 2454723 | A | 5/2009 |

* cited by examiner

VAPOR BARRIER FOR FLAMMABLE LIQUID STORAGE TANKS

CROSS-REFERENCE TO RELATED APPLICATION

This application claims the benefit of U.S. Provisional Patent Application Ser. No. 61/213,265, filed May 21, 2009.

BACKGROUND OF THE INVENTION

1. Field of the Invention

The present invention relates to storage tanks for flammable liquids, and particularly to a vapor barrier for flammable liquid storage tanks that provides a vapor impermeable barrier layer with fire-suppressing capabilities for covering a surface of the flammable liquid.

2. Description of the Related Art

Flammable liquids, such as oil, gasoline and the like, must be stored in specialized storage tanks due to the flammable vapor that forms above the liquid surface. A common storage tank, often used in the petrochemical industry, is the "floating roof" tank. A typical floating roof tank is illustrated in FIG. 2. Tank 100 includes a hollow cylindrical housing 112 having an open upper end. The open upper end is sealed by a buoyant cover 114, having a circular contour matching the dimensions of the interior of housing 112. Cover 114 floats on the flammable liquid L contained within the housing 112, thus providing a seal between the surface of the liquid L and the outside environment, preventing the buildup of flammable vapor (and exposure thereof to external hazards, such as sparks).

Typically, the cover 114 is fabricated from metal and has a hollow chamber divided by walls into an array of pontoons in order to provide sufficient flotation to carry the weight of the cover plus additional weight, such as the weight of snow which might form on the cover 114. In older oil tank equipment, the cover was constructed of a metal plate with pontoons mounted beneath the cover plate, while modern tanks typically have the pontoons located above the metal cover plate. Repairs to the cover may require welding equipment, which can be used only after the tank has been taken out of service in order to ensure that the cover is clean and that there are no flammable vapors present. If any flammable vapors are present during repair work on the cover, such as the repair of a pontoon of the cover, a spark from the welding may ignite an explosive burning of the vapor.

Repairs may also be made without taking the tank out of service. For example, one of the pontoons may sustain a relatively small opening through which liquid can seep resulting in a loss of buoyancy. By means of an access port, a person may enter the pontoon and apply foamed urethane plastic as a liquid that later hardens to maintain buoyancy. Use of the plastic is not intended as a permanent repair because the plastic may become impregnated with the flammable liquid. Further, the plastic is disadvantageous because, at the conclusion of the service interval when reconditioning is mandatory, it is very difficult to remove the plastic so as to be able to clean the cover and make any permanent repairs. Obviously, welding cannot be employed for repair until all liquid and liquid soaked flotation, such as the foamed plastic, has been removed.

As an alternative procedure of repair, one might consider insertion in the pontoons of hollow, non-foamed plastic bodies to provide sufficient buoyancy so that it is not necessary to repair the leak in the pontoon. However, the use of a plastic hollow body, such as a hollow ball, has been avoided in the petrochemical industry because such a plastic body is electrically insulating and susceptible to developing a static electric charge. There is a danger that the flotation body may suddenly discharge via a spark, which can ignite an explosion.

Additionally, in the past, foam products have also been applied to the surfaces of flammable liquids, creating an effective vapor seal between the flammable liquid and the vapor space thereabove. However, the foam degrades within a short period of time, thus defeating the desired suppression qualities. Moreover, foam applied in the event of a flammable-liquids fire is the traditional form of fire fighting, with the intent of the foam being to cool the surface of the liquid and to also separate the flammable liquid from contact with oxygen, thus suppressing the fire. The difficulty with this traditional method of using foam is that the strong convective hot air currents caused by the fire tend to displace the foam, thus exposing the flammable liquid to the existing fire.

Further, marine vessels currently do not typically employ any physical barrier between a stored flammable liquid and the vapor space formed thereabove. Typically, such vessels employ inert gas generators that create an oxygen-deficient gas that is maintained above the flammable liquid in order to preclude the flammable vapor from mixing with oxygen that might otherwise create a flammable atmosphere. Such systems, however, do not provide backup prevention in case the gas generator fails.

Thus, a vapor barrier for flammable liquid storage tanks solving the aforementioned problems is desired.

SUMMARY OF THE INVENTION

The vapor barrier for flammable liquid storage tanks provides a gas impermeable layer for covering the surface of a flammable liquid stored within a conventional flammable liquid storage tank. The vapor barrier further provides fire-suppression capabilities, and it should be understood that the vapor barrier may be applied to tankers, vessels, barges or any other type of container for flammable liquids. The vapor barrier prevents the build-up of flammable vapors over the flammable liquid surface. The vapor barrier is formed from a plurality of spherical buoyant members. Each spherical buoyant member has a heat-resistant core or shell, a heat-reactive intumescent or flame retardant layer formed on an outer surface of the heat-resistant core or shell, and an antistatic layer formed on an outer surface of the heat-reactive intumescent layer. The antistatic layer is also preferably formed from an oil-phobic material. Further, each spherical buoyant member has a specific gravity selectively chosen so that the spherical buoyant members float at a desired level within the flammable liquid.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
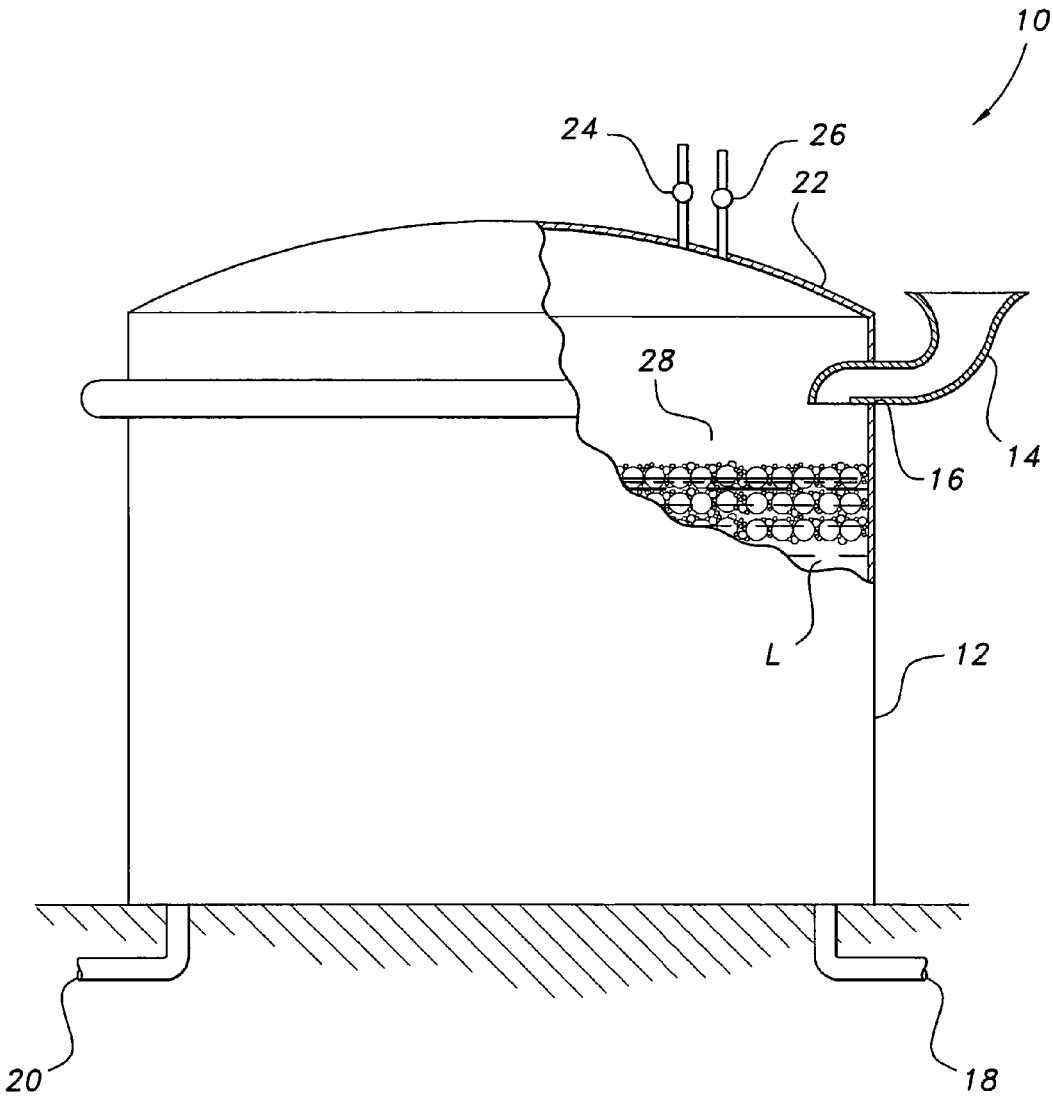
FIG. 1 is an environmental front view of a flammable liquid storage tank, the tank being broken away to show a vapor barrier for flammable liquid storage tanks according to the present invention deployed therein.

Referring to FIG. 1, an exemplary storage tank 10 has a vapor barrier for flammable liquid storage tanks deployed therein, the barrier being designated generally as 28. In addition to simply preventing the escape of vapor, the vapor barrier further provides fire suppression capabilities, and it should be understood that the vapor barrier may be applied to storage tankers, vessels, barges or any other type of container for flammable liquids. The liquid storage tank 10 is shown for exemplary purposes only and includes elements conventionally found in storage tanks for flammable liquids, such as oil, gasoline and the like. The housing 12 may be formed from steel or the like, as is conventionally known, and is either supported above the ground surface, or is at least partly buried in the ground. The tank is provided with a cover 22 and with pipes 18 and 20 for admitting flammable liquid L into the open interior region of housing 12, and for the withdrawal thereof when required. It should be understood that the vapor barrier 28 may be used with any suitable type of flammable liquid L, such as liquid natural gas, petroleum oil, gasoline or the like.

The surface of the liquid L is provided with at least one layer of buoyant bodies or spheres forming the vapor barrier layer 28, as will be described in greater detail below. The cover 22 may be further provided with a vent 26 and/or with an admission valve 24 for admitting an inert gas to the space above the stored liquid L, as is conventionally known. Preferably, a port 16 is formed through the sidewall of the housing 12, allowing the selective insertion of the vapor barrier layer 28 (in the form of individual spherical members, as will be described below) within the housing 12 via a chute 14. It should be understood that the chute 14 is shown for exemplary purposes only. It should be further understood that the vapor barrier layer 28 may be introduced into housing 12 in any suitable manner, such as, for example, through existing tank openings. Port 16 and chute 14 are shown for exemplary purposes only.

Figure 3:
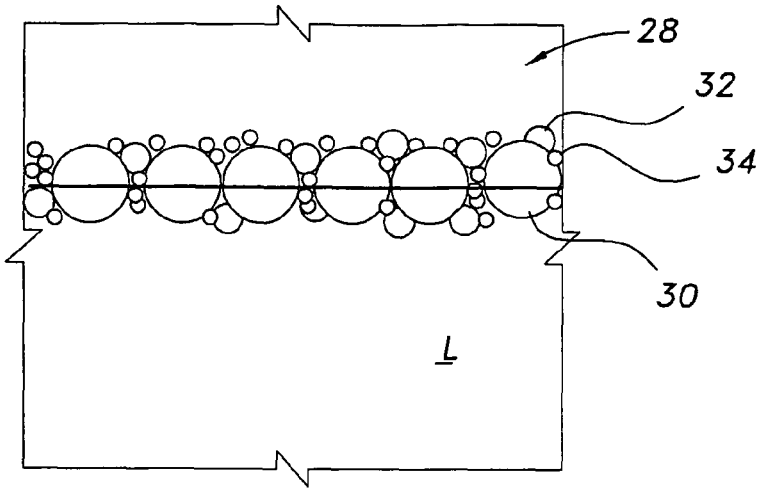
FIG. 3 is an environmental, partial side view of the vapor barrier for flammable liquid storage tanks according to the present invention.

As best shown in FIG. 3, the vapor barrier 28 is preferably formed as a buoyant layer through the stacking of multiple sizes of buoyant members 30, 32, 34. Each buoyant member 30, 32, 34 is preferably spherical, the buoyant members 30 having the largest radii, the buoyant members 34 having the smallest radii, and the buoyant members 32 having radii therebetween. It should be understood that the relative dimensions illustrated in FIG. 3 are shown for exemplary purposes only, and that a wider variety of buoyant members having distinct radii may be utilized.

The spherical contour of the buoyant members 30, 32, 34 allows for a stacked, interlocking arrangement, as shown in FIG. 3, the buoyant members naturally settling under the force of gravity into a gas-impermeable layer when inserted into the housing 12 to float on the surface of flammable liquid L. The specific gravity of the buoyant members 30, 32, 34 is preferably in the range of between 0.05 and 0.5 so that the buoyant members 30, 32, 34 will remain partially submerged within liquid L, as shown, when flammable liquid L is a common flammable material, such as petroleum oil or gasoline. It should be understood that the specific gravity may be varied, depending upon the particular composition of the flammable liquid L. The specific gravity is selected such that the buoyant members are partially submerged so that the buoyant members provide a lower cross-sectional area below the level of the liquid L in the event of thermal wind currents or convective thermal air currents generated within the tank 10 in the event of a fire.

As shown in FIG. 3, the differently sized buoyant members 30, 32, 34 forming the vapor barrier layer 28 form a suppressing blanket effect for the surface of liquid L, minimizing possible liquid-vapor contact within tank 10 (of FIG. 1). The smaller spherical bodies 32, 34 fill in gaps between the larger bodies 30, thus blocking potential evaporation paths from the surface of the liquid L. Additional layers create interstitial vapor pockets, trapping vapors therein and preventing the release thereof into the area above the vapor barrier 28.

Figure 4:
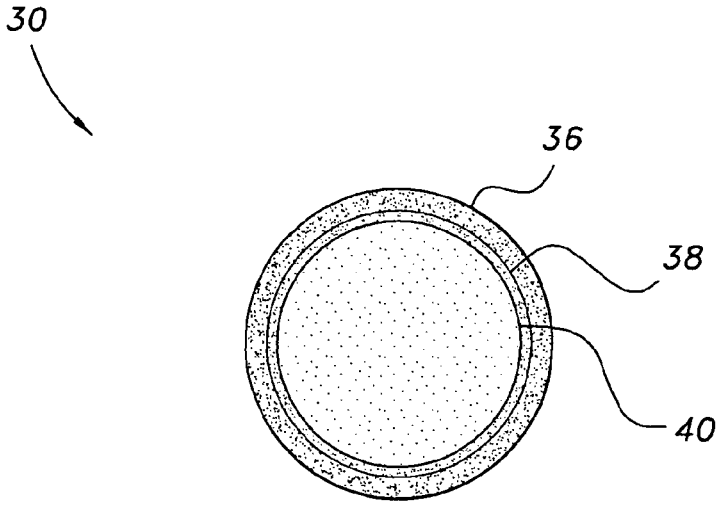
FIG. 4 is a section view of a single buoyant member of the vapor barrier for flammable liquid storage tanks according to the present invention.

As shown in FIG. 4, each buoyant member is preferably formed from three layers. A single buoyant member 30 is shown in FIG. 4, although it should be understood that buoyant members 32, 34 are formed from identical materials, although having differing radii. The central layer or core 40 is formed from a material that is non-reactive to petroleum products and that can withstand temperatures of approximately 350° F. or greater without melting. Although shown as being solid, it should be understood that core 40 may also be in the form of a hollow shell or the like. The core 40 may be coated with an intumescent layer 38. In the event of a fire within tank 10 of FIG. 1, the intumescent layer 38, which is heat reactive, expands, thus ensuring that buoyant members 30, 32, 34 form a vapor-impermeable barrier. Alternatively, the intumescent layer 38 may be replaced with a flame-retardant material, thus providing protection for the core 40. Heat-reactive, expanding foam materials that are non-reactive with petroleum products and that can withstand relatively high temperatures are well known, and any suitable heat-reactive intumescent material (or, alternatively, flame retardant material) may be utilized. In use, the smaller buoyant members, as best illustrated in FIG. 3, fall into the spaces between the larger buoyant members, thus forming a nearly continuous barrier against escaping vapor. This continuous barrier acts as a floating roof for preventing escape of the flammable vapor. In use, with liquid natural gas or a similar substance, which is a liquid at cryogenic temperatures, the vapor barrier 28 forms a thermal insulation layer, preventing the cryogenic liquid from boiling off too quickly.

As noted above, alternatively, the middle layer 38 (best seen in FIG. 4) may be formed from any suitable flame retardant material, the flame retardant material replacing the intumescent material. The middle layer 38 is also referred to herein as the intumescent layer 38, the fire retardant layer 38, or the median layer. The outer layer 36 is formed from oil-phobic and antistatic material. The outer layer 36 is also referred to herein as the oil-phobic and antistatic layer 36. Layer 36 is preferably further hydrophobic. The outer layer 36 may be formed from, for example, a high-density plastic resin mixed with an antistatic additive or agent. The antistatic agent is effective in converting the electrically insulating plastic into an electrically conductive material that does not develop a static electrical charge. Antistatic materials are well known. One example of such a material capable of being mixed with a high-density plastic resin is manufactured under the mark GLYCOSTAT, manufactured by Lonza® of Fair Lawn, NJ. It should be understood that the core 40, the intumescent or fire retardant layer 38, and the oil-phobic and antistatic layer 36 may be formed from any suitable materials, preferably so that the overall structure has a specific gravity within the range of approximately 0.05 and 0.5.

The spherical buoyant members 30, 32, 34 may have any desired size, although in the preferred embodiment, the diameters of the buoyant members are preferably within the range of approximately 1/16 of an inch to four inches. It should be understood that members 30, 32, 34 may include all three layers of material, or may include any combination thereof. For example, intumescent or flame retardant coating 38 is preferably applied at a relatively large thickness, and this may only be able to be applied to the largest members 30 in order to maintain buoyancy. In this example, members 32, 34 would only include the core 40 and the antistatic and oil-phobic coating 36. Alternatively, the intumescent or flame retardant material may be used as an outer shell for the spherical members, rather than being solely formed in the core. It should be understood that any combination of the above-described layers and materials may be used, depending upon the liquid and the container.

Figure 2:
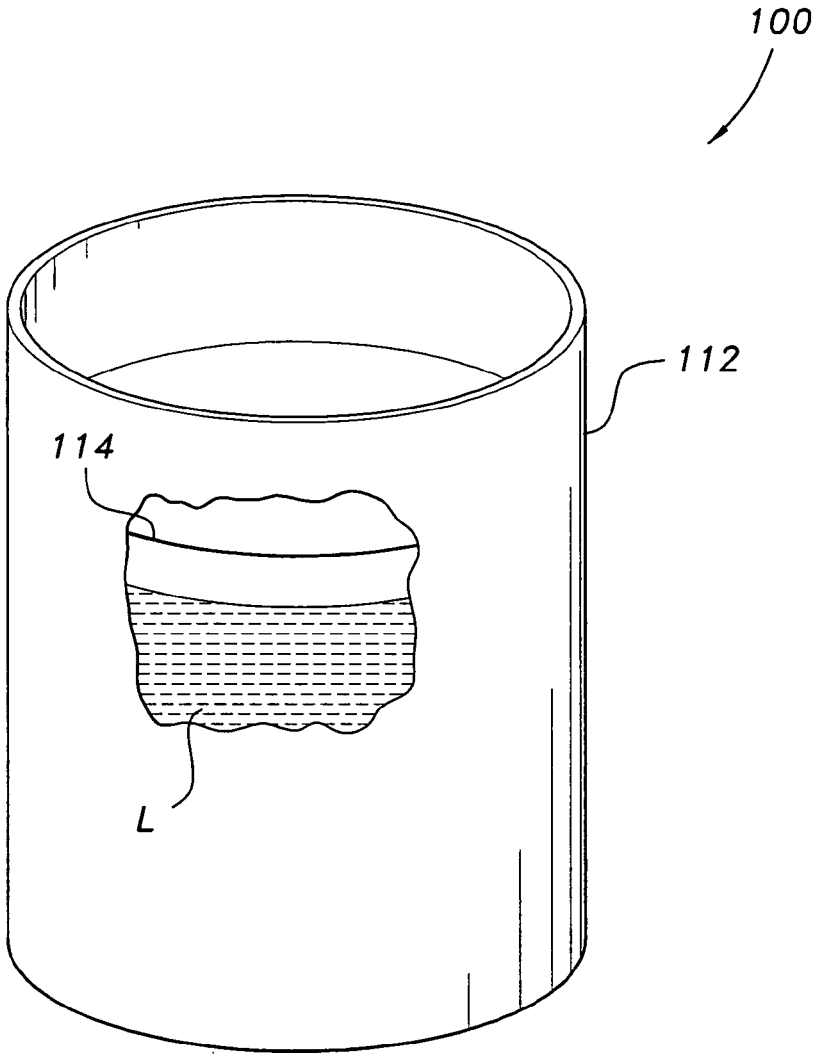
FIG. 2 PRIOR ART
FIG. 2 is a perspective view of a flammable liquid storage tank according to the prior art, broken away to show a portion of the interior of the tank and contents thereof.
Figure 5:
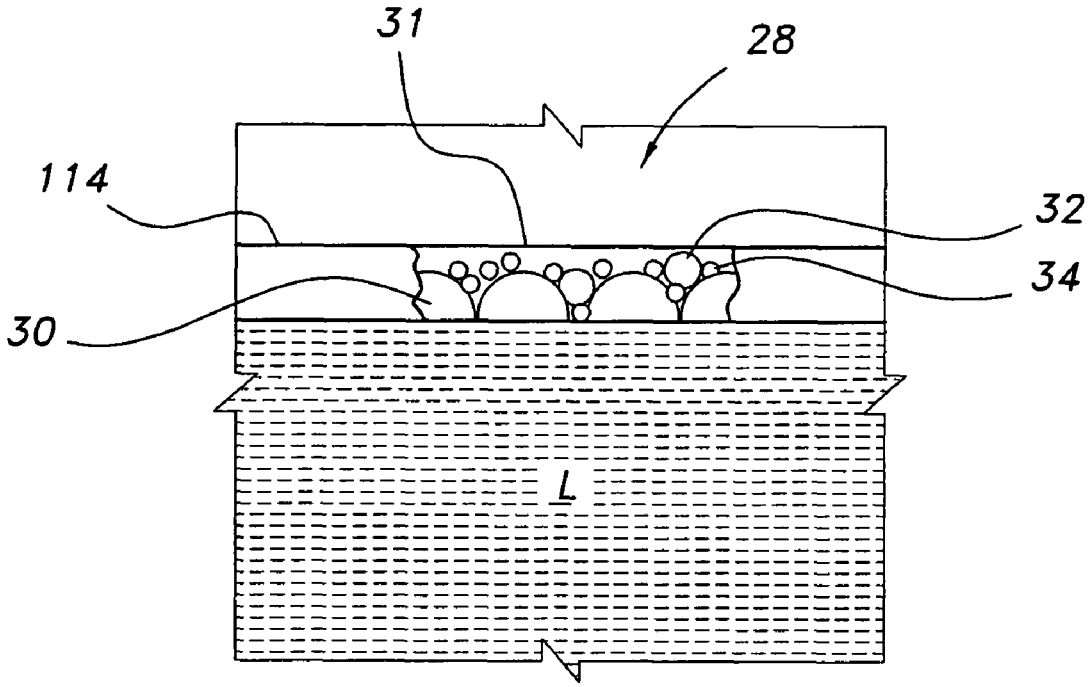
FIG. 5 is an environmental, diagrammatic front view of an alternative embodiment of a vapor barrier for flammable liquid storage tanks according to the present invention.

FIG. 5 illustrates an alternative embodiment of the vapor barrier in which the vapor barrier layer 28 is combined with the conventional floating roof 114 of FIG. 2. Conventional floating roofs are typically formed as circular pans having a planar floor and a raised peripheral rim defining an open interior region in the upper side thereof. Such roofs may sink due to environmental conditions, such as earthquakes or other external stresses, causing the pan to tilt and thus fill with liquid L. Some floating roofs include a central drain, but this can become clogged by snow or ice, for example.

In FIG. 5, a floating roof 114 is positioned within the tank, as in FIG. 2, but with a bag 31 containing members 30, 32 and 34 positioned within the open interior region thereof. The bag 31 is formed from a readily dissolvable material so that if floating roof 114 sinks, the bag 31 will dissolve in liquid L and a vapor barrier layer 28 will cover the surface of liquid L as described above, thus adding an additional layer of protection. It should be understood that any suitable number of bags 31 containing members 30, 32, 34 may be positioned within the upper interior region of roof 114, and that the bags 31 may be formed of any suitable material that is readily dissolvable in a petroleum-based liquid. Additionally, it should be understood that any suitable type of container may be utilized, and that bag 31 is shown for exemplary purposes only.

As noted above, the vapor barrier may be applied to any type of storage tank, storage vessel, etc. For example, the vapor barrier may be used with conventional rectangular tanks or irregularly shaped tanks, such as those typically found on crude oil tankers or barges. Such tankers and barges typically have no floating vapor seal due to the difficulties of maintaining a sealing surface during the turbulent and oscillatory motion of the flammable liquid while the vessel is in motion.

The vapor barrier acts to suppress the evaporation of the flammable liquid into the vapor space above the liquid surface, and further provides a thermally activated barrier in the event of a fire. The spheres provide an effective thermal barrier absent sufficient heat to activate the intumescent layer. In the presence of sufficient heat (e.g., a fire within the tank, above the liquid surface), the barrier would be formed by the reaction of the intumescent layers of the spheres. Further, as noted above, the spheres may be added to the tank following a detection of fire in order to suppress the fire, either in support of, or in lieu of, fire fighting foam or other substances. Additionally, it should be understood that the spherical members may have additional coatings applied thereto. For example, a fourth layer, in the form of an outer coating, may be formed about layer 36, with the outer coating being oil-absorbent to wick up oil during an oil spill on water. Alternatively, the present antistatic and oil-phobic coating 36 may be replaced by an antistatic and oil-philic coating.

It is to be understood that the present invention is not limited to the embodiments described above, but encompasses any and all embodiments within the scope of the following claims.

I claim:

1. A vapor barrier for flammable liquid storage tanks, comprising a plurality of spherical buoyant members, each of the buoyant members having a heat-resistant core, a median layer formed on an outer surface of the heat-resistant core, and an antistatic layer formed on an outer surface of the median layer.

2. The vapor barrier for flammable liquid storage tanks as recited in claim 1, wherein said median layer is formed from a heat-reactive intumescent material.

3. The vapor barrier for flammable liquid storage tanks as recited in claim 1, wherein said median layer is formed from a flame retardant material.

4. The vapor barrier for flammable liquid storage tanks as recited in claim 1, wherein said plurality of spherical buoyant members includes a plurality of sets of spherical buoyant members, each of the sets having a uniform, unique buoyant member radius.

5. The vapor barrier for flammable liquid storage tanks as recited in claim 4, wherein each said spherical buoyant member has a diameter in the range of about 1/16 of an inch to about four inches.

6. The vapor barrier for flammable liquid storage tanks as recited in claim 1, wherein each said spherical buoyant member has a specific gravity in the range of about 0.05 to about 0.5.

7. The vapor barrier for flammable liquid storage tanks as recited in claim 1, wherein said antistatic layer is oil-phobic.

8. The vapor barrier for flammable liquid storage tanks as recited in claim 1, wherein said antistatic layer is oil-philic.

9. A flammable liquid storage tank having a vapor barrier, comprising:

a hollow housing having an open upper end, the housing defining a storage tank adapted for receiving a volume of flammable liquid therein; and a vapor barrier having a plurality of spherical buoyant members, each of the buoyant members having a heat-resistant core, a median layer formed on an outer surface of the heat-resistant core, and an antistatic layer formed on an outer surface of the median layer, the buoyant members being adapted for floating on and forming a surface covering for the flammable liquid.

10. The flammable liquid storage tank as recited in claim 9, wherein said antistatic layer is hydrophobic.

11. The flammable liquid storage tank as recited in claim 10, wherein said median layer is formed from a heat-reactive intumescent material.

12. The flammable liquid storage tank as recited in claim 10, wherein said median layer is formed from a flame retardant material.

13. The flammable liquid storage tank as recited in claim 10, wherein said plurality of spherical buoyant members includes a plurality of sets of spherical buoyant members, each of the sets having a uniform, unique buoyant member radius.

14. The flammable liquid storage tank as recited in claim 13, wherein each said spherical buoyant member has a diameter in the range of about 1/16 of an inch to about four inches.

15. The flammable liquid storage tank as recited in claim 10, wherein each said spherical buoyant member has a specific gravity in the range of about 0.05 to about 0.5.

16. The flammable liquid storage tank as recited in claim 10, wherein said antistatic layer is oil-phobic.

17. The flammable liquid storage tank as recited in claim 10, wherein said antistatic layer is oil-philic.

18. A flammable liquid storage tank having a vapor barrier, comprising:

a hollow housing having an open upper end, the housing defining a storage tank adapted for receiving a volume of flammable liquid therein;

a floating roof having an upper, open interior region defined therein and a lower surface adapted for floating on a surface of the volume of flammable liquid; and a vapor barrier disposed within the upper, open interior region of the floating roof, the vapor barrier having a plurality of spherical buoyant members, each of the buoyant members having a heat-resistant core, a median layer formed on an outer surface of the heat-resistant core, and an antistatic layer formed on an outer surface of the median layer.

19. The flammable liquid storage tank tanks as recited in claim 18, wherein said median layer is formed from a heat-reactive intumescent material.

20. The flammable liquid storage tank as recited in claim 18, wherein said median layer is formed from a flame retardant material.

* * * * *

UNITED STATES PATENT AND TRADEMARK OFFICE

CERTIFICATE OF CORRECTION

PATENT NO. : 8,297,460 B2
APPLICATION NO. : 12/662655
DATED : October 30, 2012
INVENTOR(S) : Joseph Riordan It is certified that error appears in the above-identified patent and that said Letters Patent is hereby corrected as shown below:

Column 4, line 26: replace “F.” with --F--

Column 8, line 8, Claim 19: delete the word “tanks”

Signed and Sealed this
First Day of January, 2013

David J. Kappos

David J. Kappos
*Director of the United States Patent and Trademark Office*